US008223138B2

(12) United States Patent
Boiko

(10) Patent No.: US 8,223,138 B2
(45) Date of Patent: Jul. 17, 2012

(54) PARTIAL FRAME MEMORY FPR DISPLAY DEVICE AND WRITING AND READING METHOD THEREOF

(75) Inventor: Evgueni Boiko, Horley (GB)

(73) Assignee: Chimei Innolux Corporation, Miao-Li County (TW)

( * ) Notice: Subject to any disclaimer, the term of this patent is extended or adjusted under 35 U.S.C. 154(b) by 1092 days.

(21) Appl. No.: 12/093,068

(22) PCT Filed: Oct. 30, 2006

(86) PCT No.: PCT/IB2006/054012

§ 371 (c)(1),
(2), (4) Date: May 8, 2008

(87) PCT Pub. No.: WO2007/054854

PCT Pub. Date: May 18, 2007

(65) Prior Publication Data

US 2009/0046104 A1 Feb. 19, 2009

(30) Foreign Application Priority Data

Nov. 10, 2005 (EP) ..... 05110604

(51) Int. Cl.
*G09G 5/00* (2006.01)

(52) U.S. Cl. ..... 345/204

(58) Field of Classification Search ..... 345/204
See application file for complete search history.

(56) References Cited

U.S. PATENT DOCUMENTS 3,869,195 A * 3/1975 Aldrich et al. ..... 349/69
5,130,829 A 7/1992 Shannon
5,495,265 A 2/1996 Hartman et al.
5,912,651 A 6/1999 Bitzakidis et al.
6,014,126 A 1/2000 Nishihara
2002/0126218 A1 9/2002 Willis ..... 348/459
2003/0006948 A1 1/2003 Son et al.
2004/0012551 A1 1/2004 Ishii
2005/0052394 A1 * 3/2005 Waterman ..... 345/98
2005/0078069 A1 4/2005 Aiba et al.
2005/0140635 A1 6/2005 Kwon (Continued)

FOREIGN PATENT DOCUMENTS

CN 1374636 10/2002

(Continued)

OTHER PUBLICATIONS

EP Search Reoirt and Written Opinion for EP Application No. 06821253.9, dated Jan. 9, 2009.

*Primary Examiner* — Nitin Patel
*Assistant Examiner* — Andrew Schnirel
(74) *Attorney, Agent, or Firm* — Thomas|Kayden

(57) ABSTRACT

An active matrix display device comprises a plurality of pixels, and driving circuitry arranged to drive each pixel with a pre-determined drive voltage level during a first phase (41) followed by an overdrive drive voltage level during a second phase (44). A partial frame store is for storing a fraction of the pixel data for the display. Input video data is written into the partial frame store (40) at a first rate and is read out of the partial frame store at a second rate which is greater than the first rate. The data read out of the partial frame store is processed for deriving the overdrive drive voltage level.

21 Claims, 7 Drawing Sheets

U.S. PATENT DOCUMENTS

| | | | | |
|---|---|---|---|---|
| 2005/0280612 | A1* | 12/2005 | Yamamoto et al. | 345/75.2 |
| 2006/0238486 | A1* | 10/2006 | Hiraki | 345/102 |

FOREIGN PATENT DOCUMENTS

| | | | |
|---|---|---|---|
| EP | 1197944 | A2 | 4/2002 |
| EP | 1489590 | A1 | 12/2004 |
| JP | 2002149132 | A | 5/2002 |
| JP | 2004-294540 | | 10/2004 |
| JP | 2005-309326 | | 11/2005 |
| WO | WO2004013835 | A1 | 2/2004 |
| WO | 2004/044878 | A2 | 5/2004 |
| WO | WO2004044878 | A2 | 5/2004 |

* cited by examiner

PARTIAL FRAME MEMORY FPR DISPLAY DEVICE AND WRITING AND READING METHOD THEREOF

BACKGROUND OF THE INVENTION

1. Field of the Invention

The present invention relates to matrix display devices and systems, and to driving or addressing methods for such display devices.

2. Description of the Related Art

Liquid crystal display devices are well known, and usually comprise a plurality of pixels arranged in an array of rows and columns.

Typically the pixels are addressed or driven as follows. The rows of pixels are selected one at a time. The pixels within the row currently selected are provided with respective display settings by virtue of respective data voltages being applied to each of the columns. Such data voltages are known by a number of names in the art, including data signals, video signals, image signals, drive voltages, column voltages, and so on.

Selection of each of the rows one by one, with driving of the columns as required during each row selection, provides display of one frame of the image being displayed. The display is then refreshed by a further frame being displayed in the same manner, and so on.

The level of a data voltage applied to a pixel determines how much light is output by that pixel by controlling the extent of the optical modulation effect of the liquid crystal layer in the pixel. It is known that due to capacitance effects and time-response of the liquid crystal layer, the liquid crystal layer can fail to reach the optical modulation condition it would reach in a steady-state situation for a given drive voltage by the end of the time the drive voltage is applied in the addressing scheme. A correction method called overdrive correction (ODC) (which may also be termed overdrive compensation) has been employed to alleviate this effect.

Under ODC, a pixel is driven at a higher or lower voltage level than the voltage level that would be required for steady-state operation, so that by the end of the relevant voltage application period, the voltage present across the pixel has reached a level estimated to be substantially equal to what the steady-state level should be. Further details of known ODC methods are described in U.S. Pat. No. 5,495,265 and WO 2004/013835, which are incorporated herein by reference.

The correction to be applied under ODC (i.e. how different the level of voltage applied to the pixel to achieve a given voltage across the liquid crystal layer of the pixel is from the given voltage) varies according to the liquid crystal panel design. Moreover the required correction varies according to what voltage level a pixel is at in the frame prior to that being corrected, and what voltage level is being sought in the present frame i.e. the current pixel data setting and the next pixel data setting (this is often referred to as a voltage pair). The correction required is typically calculated anew for each pixel for each frame. Thus, in conventional ODC schemes, it is required to have a frame buffer, so the voltage pairs can be determined, a look-up table comprising a matrix of many voltage pairs and many voltage settings (and possibly different panels) so the appropriate correction can be read-off for the determined voltage pair, and a processor for determining the correction from these items.

In addition, in order to implement ODC for grey level transitions toward or near the extremes of the liquid crystal transmission curve, additional buffers and/or increased selector matrix complexity in the panel driver IC are typically needed, resulting in increased silicon area and cost.

Liquid crystal displays often have a backlight, e.g. a fluorescent lamp, arranged such that such that light from the backlight passes through the pixels where it is modulated by the liquid crystal layer. US 2004/0012551 A1 describes a variable backlight control system employed in a driving scheme.

It is separately known to drive other liquid crystal panels with so-called black fields inserted between the picture image fields, i.e. a driving scheme is employed in which in each frame a pixel is driven for some of the time at a data voltage level and for the rest of the frame is driven in black mode, as described in U.S. Pat. No. 5,912,651 which is incorporated herein by reference. The visual effect perceived by a viewer is such that this approach can reduce the blurring effect of a moving image.

The present inventors have realised it would be desirable to provide ODC driving schemes for matrix display devices that alleviate or reduce the large amount of processing required with conventional ODC schemes. The present inventors have also realised it would be desirable to provide ODC driving schemes for matrix display devices that reduce the size of frame buffers and/or look-up tables as used in conventional ODC schemes.

BRIEF SUMMARY OF THE INVENTION

According to the invention, there is provided an active matrix display device, comprising:

a plurality of pixels;

driving circuitry arranged to drive each pixel with a predetermined drive voltage level during a first phase followed by an overdrive drive voltage level during a second phase;

a partial frame store for storing a fraction of the pixel data for the display;

means for writing input video data into the partial frame store at a first rate;

means for reading data out of the partial frame store at a second rate which is greater than the first rate; and processing means for processing the data read out of the partial frame store for deriving the overdrive drive voltage level.

The use of a first drive phase to a pre-determined drive level essentially resets the pixels, so that there is no need for comparison between the current pixel data and the pixel data in the previous frame. This reduces the processing and memory requirements. However, the video data needs to be in a specific format with frames inserted with the predetermined drive level. If data in a different format (without these additional frames) is to be received at the input of the device, some data processing (and therefore temporary data storage) is required.

This device uses a partial frame store to enable this processing of display data to enable an overdrive scheme to be implemented, based on conventional input video data. The use of a partial frame store is made possible by reading data into and out of the frame store memory at different rates. The use of two drive phases allows data to build up in the memory during one phase, and then to be read out in the second phase (while data is still being read in).

Preferably, the partial frame store is implemented as a circular memory so that all data read into the partial frame store is kept for a given length of time (namely as a FIFO memory).

This approach means that when it is not possible to change the format of the video data at the display interface from the conventional format, the requirement for memory is reduced while enabling an overdrive scheme to be applied.

The two-phase drive scheme also applies motion blur reduction, again with reduced overhead in terms of memory capacity.

The first rate preferably comprises the data rate of the input video data, so that input data can be processed on-the-fly.

The input video data is preferably read into the partial frame store substantially continuously, and data is read out of the partial frame store during a time period which is a fraction of the video frame period, during the second pixel drive phases.

The first and second phases can be substantially (internally) continuous and each then comprise approximately half the video frame period. In this case, the partial frame store needs a capacity which is half of the video data for a full frame.

However, the first and second phases can instead be discontinuous and comprise multiple sub-phases. In this case, during a pair of associated sub-phases, a first portion of video data is read into the partial frame store and then read out. The use of multiple sub-phases enables the partial frame store to have a smaller capacity, in particular which is a fraction 1/(2N) of the video data for a full frame, where N is the number of sub-phases.

The means for reading data out of the partial frame store at a second rate can comprise a clock multiplier circuit for doubling the frequency of the clock signal at the data rate of the input video data.

Preferably, the pre-determined drive voltage level is the same for each pixel, and the overdrive drive voltage level for each pixel comprises an overdrive corrected voltage level for each respective pixel corresponding to the data signal for the respective pixel.

The device preferably further comprises a backlight and backlight control circuitry, wherein the backlight control circuitry is arranged to switch the backlight on or off in relation to whether the driving circuitry is driving the pixels or certain pixels with the pre-determined drive voltage level or with the overdrive drive voltage level. The backlight may comprise a segmented backlight, and the backlight is driven in a scanning mode of operation.

The device is preferably a liquid crystal display.

The invention also provides a method of driving an active matrix liquid crystal display device comprising a plurality of pixels, comprising:

during a first phase: driving each pixel with a pre-determined drive voltage level, and storing data from a video input in a partial frame store at a first rate;

during a second phase: continuing to store data from the video input in the partial frame store at a first rate, reading data out of the partial frame store at a second rate which is greater than the first rate, processing the data read out of the partial frame store to derive an overdrive drive voltage level, and driving each pixel with the overdrive drive voltage level.

BRIEF DESCRIPTION OF THE DRAWINGS

Embodiments of the present invention will now be described, by way of example, with reference to the accompanying drawings, in which.

DETAILED DESCRIPTION OF THE INVENTION

Figure 1:
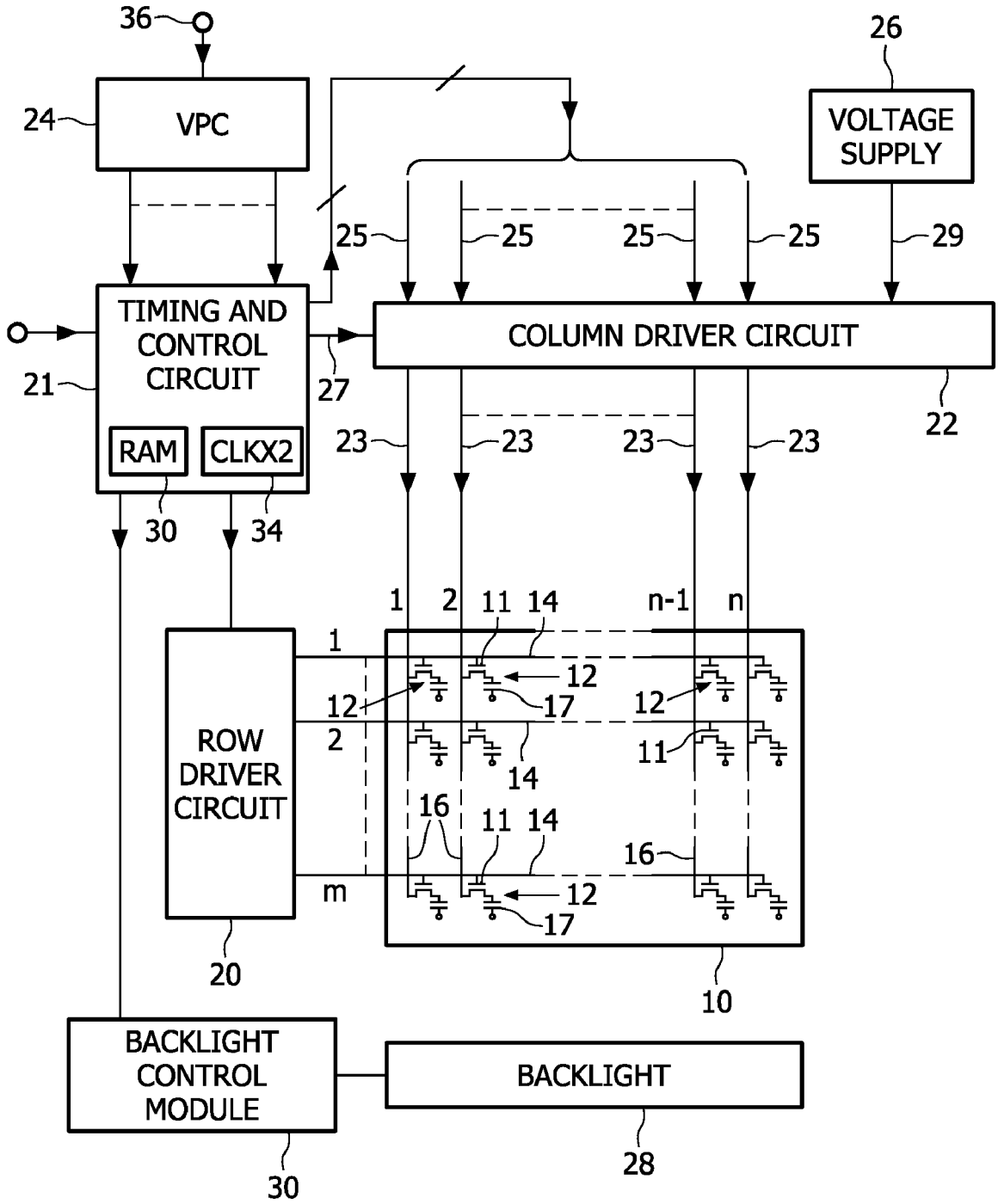
FIG. 1 is a schematic diagram of an active matrix liquid crystal display device of the invention.

FIG. 1 is a schematic diagram of an active matrix liquid crystal display device in which the invention is implemented. The display device, which is suitable for displaying video pictures, comprises an active matrix addressed liquid crystal display panel 10 having a row and column array of pixels which consists of m rows (1 to m) with n horizontally arranged pixels 12 (1 to n) in each row. Only a few of the pixels are shown for simplicity.

Each pixel 12 is associated with a respective switching device in the form of a thin film transistor, TFT, 11. The gate terminals of all TFTs 11 associated with pixels in the same row are connected to a common row conductor 14 to which, in operation, selection (gating) signals are supplied. Likewise, the source terminals associated with all pixels in the same column are connected to a common column conductor 16 to which data (video) signals are applied. The drain terminals of the TFTs are each connected to a respective transparent pixel electrode 17 forming part of, and defining, the pixel. The conductors 14 and 16, TFTs 11 and pixel electrodes 17 are carried on one transparent plate while a second, spaced, transparent plate carries an electrode common to all the pixels (hereinafter referred to as the common electrode). Liquid crystal is disposed between the plates.

A backlight 28 is disposed such that light from the backlight 28 passes through the panel and is modulated according to the transmission characteristics of the pixels 12. The backlight is controlled by a backlight control module 30.

The display panel is operated as follows. The device is driven one row at a time by scanning the row conductors 14 with a selection (gating) signal so as to turn on the rows of TFTs in turn and applying data (video) signals to the column conductors for each row of picture display elements in turn as appropriate and in synchronism with the selection signals so as to build up a complete display frame (picture). Using one row at time addressing, all TFTs 11 of the selected row are switched on for a period determined by the duration of a selection signal during which the data signals are transferred from the column conductors 16 to the pixels 12

The row conductors 14 are supplied in their order of selection with selection signals by a row driver circuit 20 comprising a digital shift register controlled by regular timing pulses from a timing and control circuit 21. In the intervals between selection signals, the row conductors 14 are supplied with a substantially constant reference potential by the row driver circuit 20.

ODC drive voltages (data voltages) 23 are supplied to the column conductors 16 from a column driver circuit 22. The column driver circuit 22 is supplied with video signals 25 initially received from a video processing circuit 24 (VPC) (which is external to the LCD panel and supplies the video stream to the LCD panel) via the timing and control circuit 21. Timing pulses 27 are also provided from the timing and control circuit 21 in synchronism with row scanning to provide serial to parallel conversion appropriate to the row at a time addressing of the panel 10. The column driver circuit 22 is further supplied with D.C. voltages 29 from a voltage supply 26. In this embodiment the D.C. voltages 29 provided by the voltage supply 26 are in the form of one or several discrete D.C. voltage levels.

Figure 2:
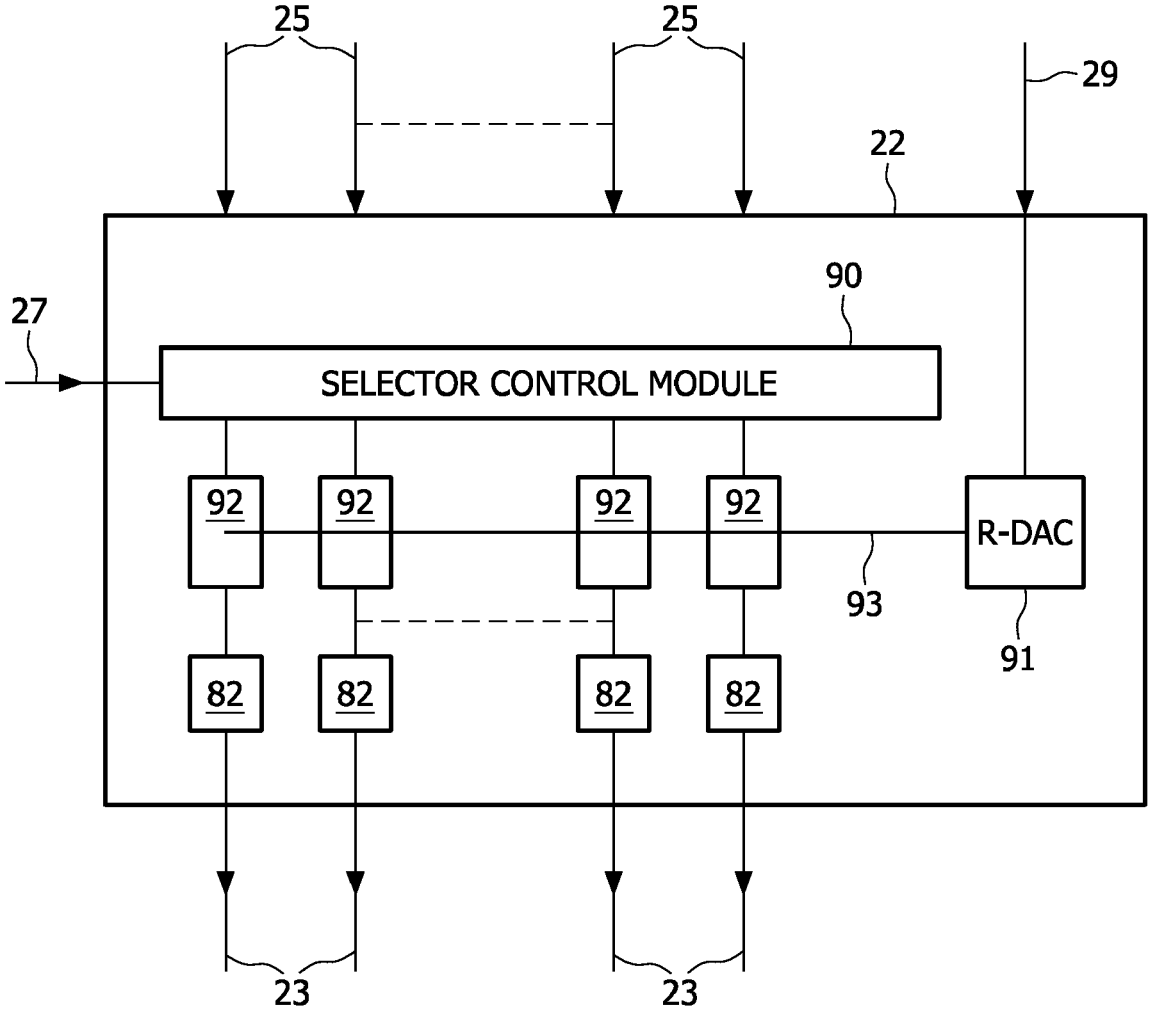
FIG. 2 is a block diagram showing a column driver circuit of the active matrix liquid crystal display device of FIG. 1.

FIG. 2 is a block diagram showing the column driver circuit 22 in more detail. The column driver circuit 22 comprises a selector control module 90 which is coupled to the timing and control circuit 21 for receiving the timing pulses 27 from the timing and control circuit 21.

The column driver circuit 22 further comprises n selectors 92, one for each of the n column conductors 16. Each selector 92 is coupled to the selector control module 90.

The column driver circuit 22 further comprises n output buffers 82, each respective output buffer 82 being coupled to a respective selector 92 and a corresponding respective common column conductor 16.

The column driver circuit 22 further comprises a resistive digital-to-analog converter (R-DAC) 91, which is coupled to the voltage supply 26 for receiving the D.C. voltages 29 from the voltage supply 26. The R-DAC 91 is coupled to each of the selectors 92 by a common bus 93 comprising N lines, one for each of N voltage levels providing a respective one of N grey levels.

In operation, the R-DAC 91 converts the D.C. voltages 29 and provides N voltage levels, one on each respective line of the bus 93, to all of the selectors 92. For each selector 92 respectively, the selector control module 90, under timing control of the timing pulses 27, instructs the respective selector 92 as to which of the N voltage levels to select in accordance with the video signal 25 received for the respective column conductor 16. The chosen voltage level is selected by the selector 92 and input into the respective buffer 82, from where it is output and applied to the column conductor 16 as a respective ODC drive voltage level 23.

Other details of the liquid crystal display device, except where otherwise stated below, may be as per any conventional active matrix liquid crystal display device driven with an ODC scheme, and are in this particular embodiment the same as, and operate the same as, the liquid crystal display device disclosed in U.S. Pat. No. 5,495,265, the contents of which are contained herein by reference. Alternatively, some or all of the details may also and/or instead be the same as the liquid crystal display device disclosed in U.S. Pat. No. 5,130,829, the contents of which are contained herein by reference.

The video processing circuit 24, the voltage supply 26 and the column driver circuit are adapted to carry out an ODC driving scheme including blank field insertion.

In this approach, each frame a pixel is driven to a predetermined level prior to being driven with an ODC level of drive voltage. The pre-determined level can be one corresponding to dark state, i.e. "black". Furthermore, in a given frame all the pixels are driven to the pre-determined level prior to all the pixels being driven with their respective ODC level of drive voltage. By virtue of this, for each pixel, and for each frame, the required ODC level of voltage is always based upon the same starting point, i.e. there is no longer any occurrence of the two-dimensional matrix of prior art ODC systems in which the data voltage to be achieved is dependent on the voltage level of the pixel in the previous frame.

In principle, this removes the need for the frame buffer and a conventional ODC look-up table with a two-dimensional matrix of given data voltages to be compared to buffered voltage levels from the previous frame.

This process does however require a different voltage drive scheme to be applied compared to a conventional ODC version of a device, hence the voltage supply 26 must be adapted accordingly to provide the required voltages. The conventional ODC driving typically requires additional voltage levels to be provided so as to cope with overdrive transitions to, or near, threshold voltage $V_{th}$ and/or saturation voltage $V_{sat}$, voltages outside of $V_{th}$ and $V_{sat}$ consequently being needed in conventional ODC arrangements.

Furthermore, in conventional ODC arrangements, certain voltage levels are required for which no ODC will occur. These different reasons for additional voltage levels tend to be avoided by using blanking phases, by virtue of the required ODC level of voltage always being based upon the same starting point, so that these variations are not included.

The backlight can be turned on and off in relation to the ODC voltage level driving and blank field driving stages.

The method above has been proposed, but not yet published, by the applicant. As mentioned above, the method requires the video data at the display interface to be in a specified format, including black frames inserted between video frame content, to provide an overdrive from black drive scheme.

This invention is based on the recognition that it is desirable to apply an ODC method with video data at the display interface which is in conventional format, in particular a format which does not require the introduction of additional black (or other fixed output) frames. It may not always be possible to specify the format of the video data at the display interface, and to introduce black frames.

It is possible to include conversion circuitry to internally convert conventional video into video with black frames inserted. However, this approach would be at the expense of re-introducing a full frame store RAM and associated logic circuit elements, for converting the video data to the required format locally.

Both RAM and EPROM can represent a significant part of the cost of a driver integrated circuit, and it is always desirable to reduce these requirements.

The invention provides a method of processing the video data in a manner which enables local conversion of the data values into values suitable for driving any desired overdrive scheme (including the introduction of black frames), but in a way which avoids the need for a full frame store.

Defining the display as having N rows, the display is divided into a number of sections S, each section containing a substantially equal number of approximately N/S rows. The most basic case is however when S=1.

A substantially exact multiple of 2 of the pixel clock at the interface is derived and the row addressing order and timing are modified, in the following manner. Each section is addressed in turn in such a way that each pixel is addressed twice during each video frame—once with 'blank' data and once with video data from a partial frame buffer RAM.

The partial frame buffer RAM is organised such that the newest data always replace the oldest data, namely using a 'wrap-around' RAM in which the data fills the RAM from top to bottom, and as soon as the entire RAM is written the process starts again from the top, overwriting previous data. When timed in a particular way, this approach requires a fraction of a full frame buffer RAM. This fraction is substantially $$\frac{1}{2S}$$

(e.g.

$$\frac{1}{2S}$$

with some margin to avoid potential conflict of reading from and writing to the same RAM location simultaneously).

A most basic implementation of this approach will be described with reference to FIG. 1.

FIG. 1 shows a partial RAM 30, which in the most basic implementation is arranged to store half a frame of data (or slightly more than half the frame of data). This is implemented as a wrap around RAM and buffer configuration. The partial RAM 30 is used by the timing and control circuit 21 for the supply of data to the column drive circuit 22, which uses the data to implement an overdrive scheme. The RAM 30 may be part of the timing and control circuit or it may be external to it.

A clock doubler is shown as 34, and this receives the data clock for the conventional video data 36 which is supplied to the video processing unit 24. This doubled clock is used by the timing and control circuit 21 for controlling the overdrive scheme.

The rows of the display are addressed at twice the normal rate at which the video data comes in at the interface, and the pixel clock is substantially doubled internally for this purpose.

During the first half of the video frame the display is addressed with 'blank' data. During the second half of the video frame, the video data stored in the frame RAM 30 is used. As this second scan using data in the RAM begins, it uses data corresponding to row 1, which is overwritten in the RAM 30 shortly afterwards. However, because the reading from the RAM occurs at substantially double the rate at which data is coming in at the interface 36, the data required for addressing the display is always present in the RAM when it is needed to be read out, even though it stores only half the full frame data.

Figure 3:
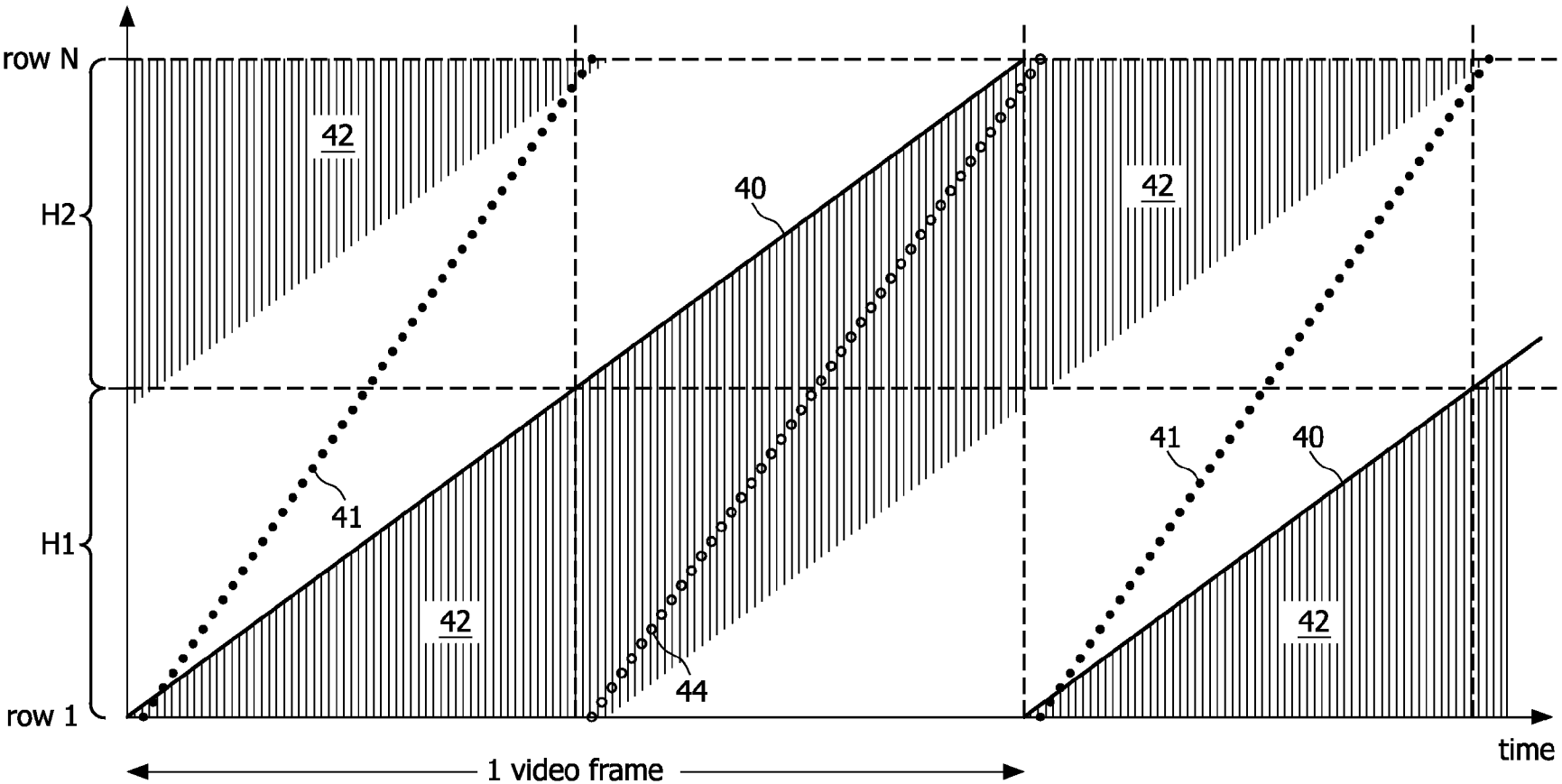
FIG. 3 is a diagram to show a first drive method of the invention.

This principle is shown more clearly in FIG. 3.

During each video frame, the video data is received at the normal frame rate, and the line 40 represents the receipt of data for the rows 1 to N uniformly over the frame time. During the first half of the video frame, the video data for the first half of the rows (H1) is received, and the pixels are driven to a blank (for example black) value. The line 41 represents the time at which different rows are addressed with blank data.

When the second half of the video frame begins, the first row of data is addressed with data, based on the data stored in the RAM. Shortly thereafter, the data for the first row is lost from the RAM. The hatched areas 42 represent the rows for which video data is stored in the RAM at a given time.

The addressing of the display using data proceeds at double the video rate, and the line 44 represents the time at which different rows are addressed with video data. The addressing of the display catches up with the video data entering the RAM, so that the video data for the last row, Row N, is only available just before the addressing scan 44 reaches the last row.

The display scanning is offset slightly in time with respect to the video data coming in at the interface. This is in order to avoid conflicts resulting from reading from and writing to the same location in RAM simultaneously. This offset is possible because the RAM is slightly larger than half of a full frame buffer RAM.

The data used for addressing the display, using the overdrive scheme, can thus be processed to derive the required drive level, and this enables conversion between a standard video data stream and drive values required for the overdrive method.

A further reduction in the size of the RAM can be obtained by splitting the display is into 2 halves (S=2). This results in the RAM being used for one quarter of the frame data, and there are four phases to the drive scheme.

Figure 4:
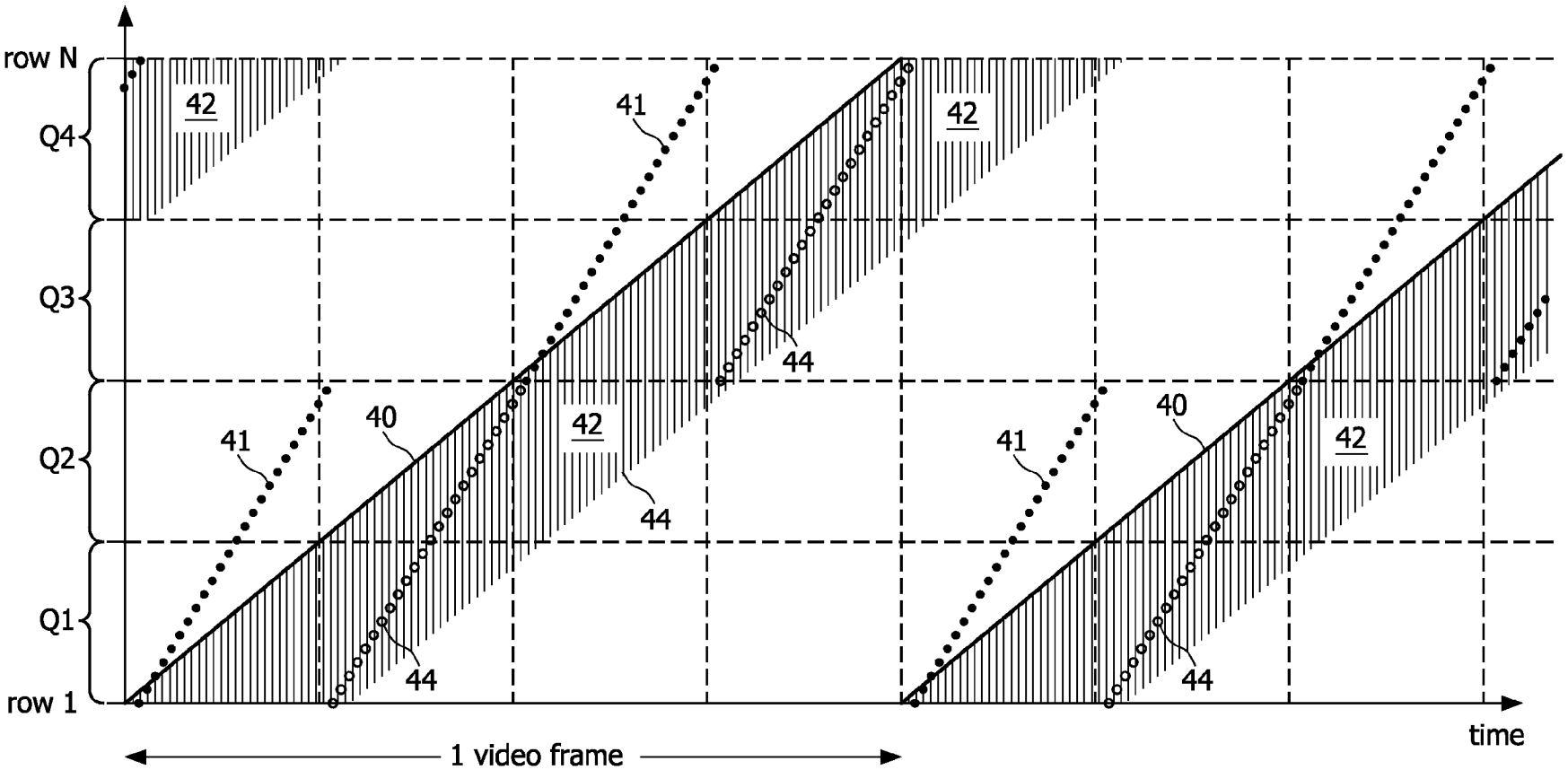
FIG. 4 is a diagram to show a second drive method of the invention.

As shown in FIG. 4, during the first quarter of the video frame, the top half of the display (Rows 1 to N/2) is addressed 'blank', shown by plot 41. During the 2nd quarter of the video frame the top half of the display is addressed again, this time with video data from the RAM shown by plot 44.

At the moment when row 1 of the display is addressed, the data for row 1 of the 1st quarter of the video frame is about to be overwritten by the data for row 1 of the 2nd quarter of the video frame. However, the reading from RAM occurs at double the rate at which the data is coming in from the interface so that the data required for addressing the display is always amongst the data that is present in the display RAM at that moment.

The same process is then repeated for the bottom half of the display. As a result, only one quarter of the full frame buffer RAM (with some additional margin) is needed at any one time.

This method of dividing the rows into sections can be implemented by connecting multiple row driver circuits independently to the timing and control circuit, so that they can be controlled individually. Multiple row driver ICs are conventionally used for large display panels.

In FIG. 4 the same reference numbers are used to denote the same data processes as in FIG. 3. The clock circuit 34 in FIG. 1 is again for multiplying the clock frequency by 2, and the RAM 30 is for slightly more than one quarter of the frame data. The functioning of this implementation follows the same principles as explained with reference to FIG. 3.

It can be seen that the drive phases are now discontinuous and comprise multiple sub-phases. Thus, the drive phase 41 comprises two time separated sub-phases, and the drive phase 44 also comprises two time separated sub-phases. During a pair of associated sub-phases, half of the video data is read into the partial frame store and then read out.

In general, the partial frame store needs a capacity which is a fraction of the video data for a full frame, and wherein the fraction is substantially equal to 1/(2N) where N is the number of sub-phases. This gives a frame store of size ¼ in this example.

As a further example, the display can be split into 3 substantially equal sections, in which case only ⅙ of a full frame buffer RAM (plus margin) is required for operation. Once again, the internal scanning is time offset to avoid simultaneous read and write operations, and the clock frequency is again multiplied by 2.

Figure 5:
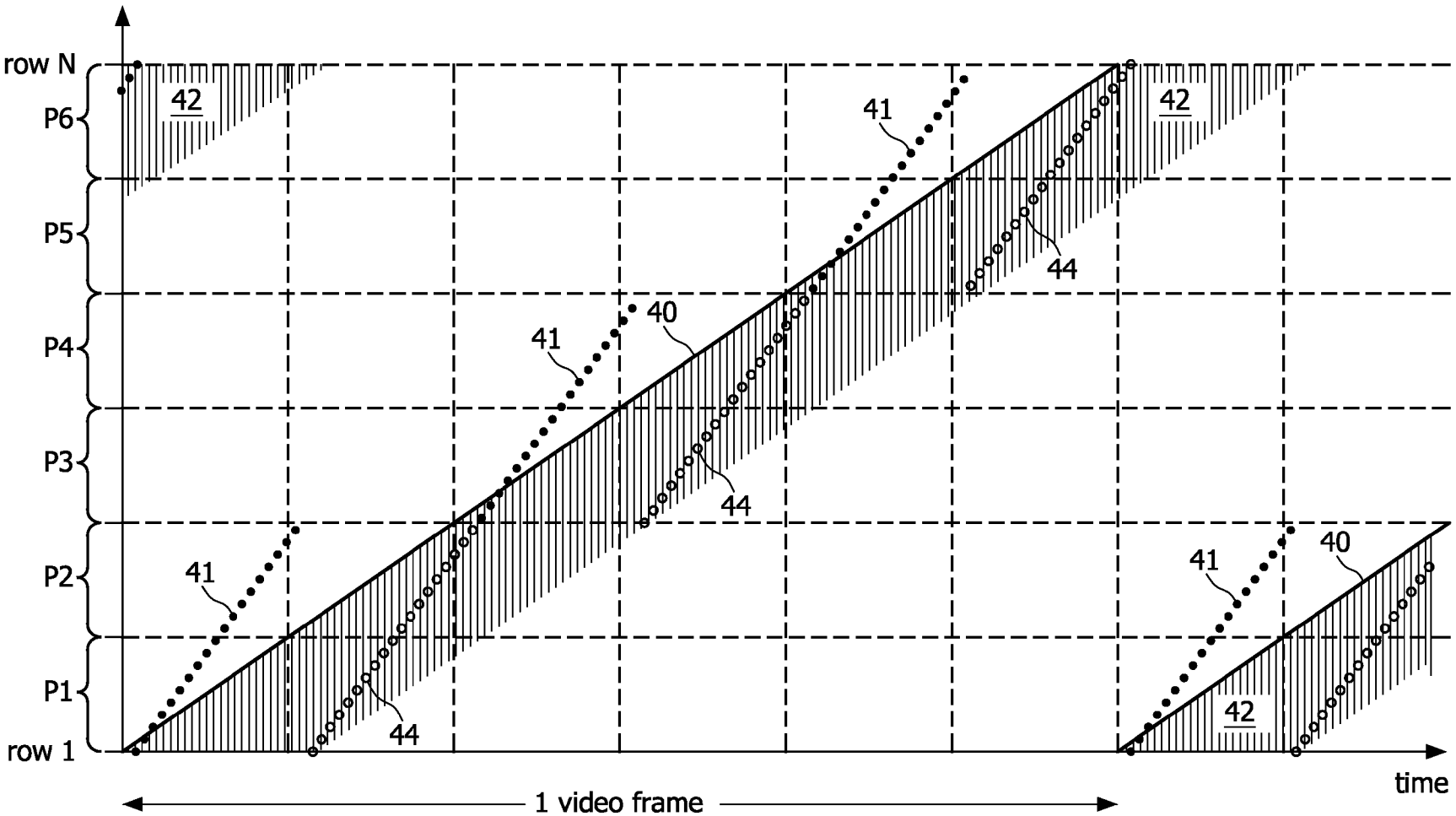
FIG. 5 is a diagram to show a third drive method of the invention.

The timing diagram is shown in FIG. 5, again with the same reference numbers, and the same principles apply. The scanning of data is in three separate phases.

The examples above avoid potential RAM read/write conflicts by providing a time lag between the reading of video data and the start of the first blank scan, and this requires a small additional amount of memory. This conflict could also be could be resolved in other ways.

For example, two clocks can be derived from the pixel clock at the interface, one faster than the exact multiple of 2 and the other slower than the exact multiple of 2. This can enable a RAM read/write conflict to be avoided without the need for a RAM that is marginally larger than 1/2S of a full frame buffer.

Figure 6:
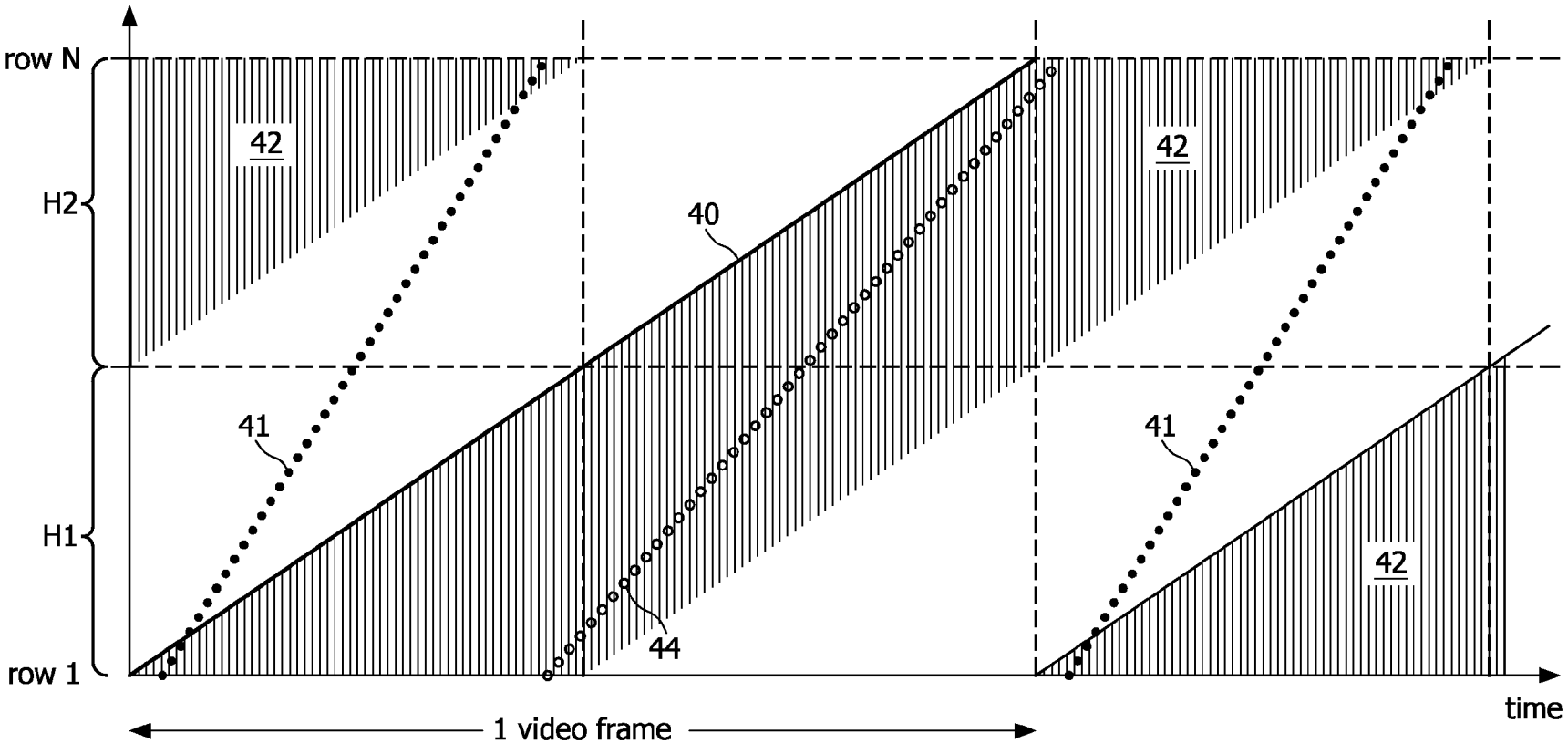
FIG. 6 is a diagram to show a fourth drive method of the invention.

For the basic case of S=1, FIG. 6 illustrates the principle. The rate at which the blank scan 41 ramps is higher than the rate at which the data scan 44 ramps, so that the data scan 44 can begin earlier than half way through the video frame, to ensure there is always a margin between the writing of data to the RAM and the reading out of data from the RAM. There is again a lag introduced but there is no need for additional memory.

The scheme above enables an overdrive scheme to be applied together with so-called 'black insertion' to moving images in order to reduce motion blur. This can be achieved using a fraction of a full frame buffer RAM whilst at the same time preserving the conventional video data format at the display interface.

The partial RAM can also be used for other functions. For example, a low power self refresh partial display mode is possible using the available RAM, to drive a part of the display in a conventional way (with no overdrive and no 'black insertion').

A number of examples have been given above, which enable different reductions in memory capability required. Clearly, the display could theoretically be split into a larger number of sections, resulting in ever smaller requirements for RAM. However, a practical limitation exists in that the liquid crystal pixels require a finite time to settle to the 'blank' level before they are addressed with the next 'video' level.

For best contrast, a scanning backlight is used with these display driving schemes.

The circuit for multiplying the frequency of the interface pixel clock need not necessarily take the pixel clock as an input. For example, since the pixel clock is expected to be fixed in the application, a free-running oscillator of the right frequency could be used as the internal display clock (possibly calibrated and temperature compensated). The amount of frequency variation that is acceptable would depend on how much margin is built into the system.

The backlight can be controlled in a number of different ways. Preferably, the backlight is operated in a scanning mode. For this purpose, the backlight is arranged as a number of portions, each portion corresponding to a number of consecutive rows of pixels, and the only portion of the backlight driven at a given time is the portion of the backlight corresponding to that group of consecutive rows of pixels in which the row being selected is located.

The backlight can then be turned off during the blank scan, and can be turned on only during the data scan. Furthermore, the backlight can be turned on only after an initial settling period after the application of data to the pixel, so that illumination is only provided when the pixel is at or approaching the desired output level.

This approach effectively divides the ODC driving into a first stage when the backlight 28 is off and a second stage when the backlight 28 is on. This approach can improve the contrast ratio of the display, since the image light level displayed is only displayed during the more stable or correct later stage rather than the more varying initial stage. Furthermore, the contrast ratio is also improved by virtue of the backlight 28 being off during the blank drive period.

Figure 7:
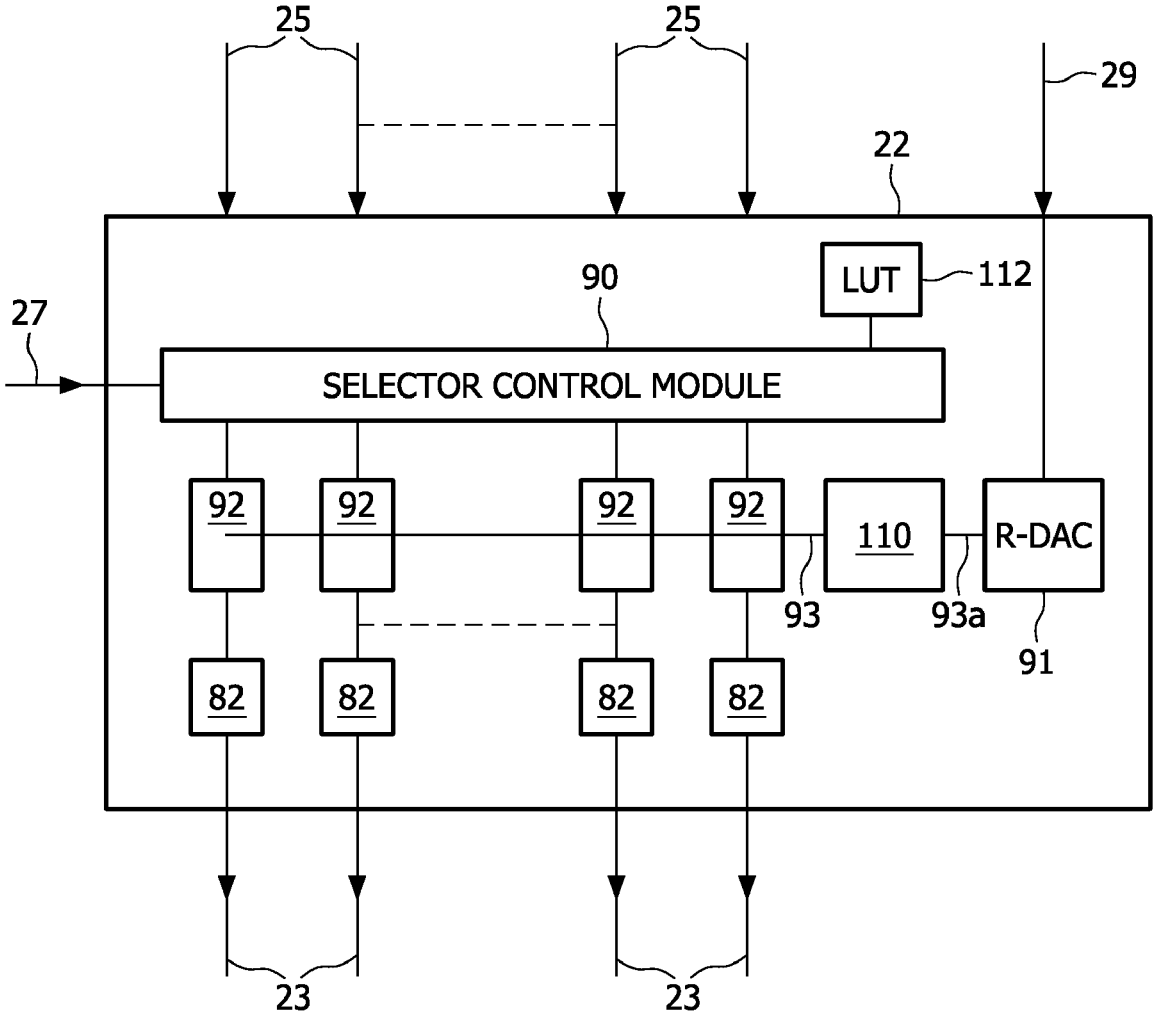
FIG. 7 is a block diagram showing another example of a column driver circuit of an active matrix liquid crystal display device as shown in FIG. 1.

It may be desirable to be able to switch between ODC mode and non-ODC mode in a given panel. The following embodiment, described below with reference to FIGS. 1 and 7, is particularly suited to providing this facility in an efficient manner.

The active matrix liquid crystal display device of this embodiment is again as shown in FIG. 1, except in this embodiment certain details of the column driver circuit 22 are different compared to the column driver circuit 22 of the first embodiment. FIG. 7 is a block diagram showing the column driver circuit 22 of this embodiment. The column driver circuit 22 of this embodiment comprises the following parts which were are also in the column driver circuit 22 of the first embodiment as shown in FIG. 2, and which are indicated by the same reference numerals: a selector control module 90, n selectors 92, n output buffers 82, and a resistive digital-to-analogue converter (R-DAC) 91. These parts are coupled together and to other parts of the active matrix liquid crystal display device in the same way as in the example of FIG. 2, except where indicated below.

The column driver circuit 22 of this embodiment further comprises a look-up table (LUT) 112 and an N-of-X selector 110, both of which are coupled to the selector control module 90. The N-of-X selector 110 is also coupled to the selectors 92 via the bus 93, and to the R-DAC 91 via a particular piece of the bus 93 indicated as bus 93*a* in FIG. 7.

In this embodiment, the D.C. voltages 29 received by the R-DAC 91 from the voltage supply 26 comprise X levels, where X>N. In operation, the N-of-X selector 110, under the control of the selector control module 90, selects, and forwards to the selectors, a set of N voltage levels from the available X voltage levels. Thus, in this embodiment, plural different sets of N voltages may be employed. Thus, for example, different sets of N voltages may be employed in order to perform temperature compensation, and/or for switching between ODC-mode and non-ODC mode. Thus, in this embodiment, design flexibility is provided in that the selector control module comprises a programmable circuit including the LUT 112 that is programmed to select the set of N voltage levels by reading off required sets of values from the LUT 112. This provides a flexible arrangement that can be used, for example, to provide a common design for use in a number of different liquid crystal panels, the appropriate voltage levels for a given type of panel being read off accordingly from the LUT.

However, in other embodiments, plural sets of voltage levels can be provided in less flexible ways, not involving an LUT, for example by having pre-determined fixed sets available, which may for example be conveniently used as a fixed design for a given type of liquid crystal panel.

The column driver circuit shown in FIG. 7 thus provides at least two dynamically selectable sets of N greyscale level voltages, one for ODC-mode and one for non-ODC mode. Further selectable sets, e.g. for reflective mode compared to transmissive mode of display operation may be provided as required. In other embodiments, other ways of providing two or more sets of dynamically selectable sets of greyscale level voltages may be implemented, for example selectable fixed sets of voltages, selectable programmable and fixed sets, and so on.

An advantage of these dynamically selectable sets of greyscale levels is that the column driver circuit 22 can be used in a variety of different panels, and the greyscale voltages can be programmed according to the particular panel to be used in any particular circumstances. Furthermore, other variables, for example temperature compensation, use of different frame rates, and so on, can be accommodated in one design of product.

In the embodiments shown in FIG. 7 and FIG. 2, the (column) buffers 82 are connected after the (1-of-N) selectors 92. This may be referred to as "buffer per column" architecture, and is typically used in large panels. In other embodiments, particularly but not exclusively for smaller panels, another so-called "buffer per grey level" architecture may be employed, in which the buffers are connected before the 1-of-N selectors i.e. one buffers (or one set of buffers) is shared by all the columns.

In each of the above embodiments, temperature compensation of the ODC driving may be implemented in similar fashion to conventional ODC driving arrangements, i.e. different ODC drive voltage level values are required for given voltage data levels according to the temperature. Such processing is simplified with the present invention compared to conventional ODC arrangements as there is typically significantly less data to be temperature compensated.

The selector control module 90 can be implemented using a look up table. A look up table will generally be desired to provide the ability to provide different gamma curves. These will enable different frame rates to be enabled as well as providing compensation for temperature. Thus, for temperature compensated overdrive, even from black, multiple gamma curves are needed. Different gamma curves are also needed for different panel designs. The use of a resistive DAC with many more taps than grey levels, and an LUT to select the voltage taps, is one way to provide this functionality.

The means for writing input video data into the partial frame store (at a first rate) and the means for reading data out of the partial frame store (at a second rate) comprise standard memory access hardware/software, and many possible implementations for the memory and access control will be apparent to those skilled in the art.

Various modifications will be apparent to those skilled in the art.

The invention claimed is:

1. An active matrix display device, comprising:

a plurality of pixels;

a driving circuitry arranged to drive each pixel with a predetermined drive voltage level during a first phase followed by an overdrive drive voltage level during a second phase; and a partial frame store of which the capacity is limited for storing at most a fraction of one full frame of the video data for the display at a time, wherein video data of a first fraction of one full frame is written into the partial frame store at a first rate during the first phase and video data of a second fraction of one full frame is continuously written into the partial frame store during the second phases, wherein during the second phase the video data of the first fraction of one full frame stored in the partial frame is overwritten by the video data of the second fraction of one full frame as soon as the entire partial frame store is written;

wherein the video data of one full frame is read out of the partial frame store at a second rate which is greater than the first rate, during only the second phase; and wherein the video data read out of the partial frame store is processed for deriving the overdrive drive voltage level.

2. The device as claimed in claim 1, wherein the first rate comprises the data rate of the input video data.

3. The device as claimed in claim 1, wherein input video data is read into the partial frame store substantially continuously, and data is read out of the partial frame store during a time period which is a fraction of the video frame period.

4. The device as claimed in claim 3, wherein data is read out of the partial frame store during the second drive phases.

5. The device as claimed in claim 3, wherein the first and second phases are substantially continuous and each comprise approximately half the video frame period.

6. The device as claimed in claim 5, wherein the partial frame store has a capacity which is a fraction of the video data for a full frame, and wherein the fraction is substantially equal to ½.

7. The device as claimed in claim 3, wherein the first and second phases are discontinuous and respectively comprise multiple sub-phases, wherein during a pair of associated sub-phases, a respective portion of video data is read into the partial frame store and then read out.

8. The device as claimed in claim 7, wherein the partial frame store has a capacity which is a fraction of the video data for a full frame, and wherein the fraction is substantially equal to 1/(2N) where N is the number of sub-phases.

9. The device as claimed in claim 1, wherein the means for reading data out of the partial frame store at a second rate comprises a clock multiplier circuit for doubling the frequency of the clock signal at the data rate of the input video data.

10. The device as claimed in claim 1, wherein the predetermined drive voltage level is the same for each pixel, and the overdrive drive voltage level for each pixel comprises an overdrive corrected voltage level for each respective pixel corresponding to the data signal for the respective pixel.

11. The device as claimed in claim 1, further comprising a backlight and backlight control circuitry, wherein the backlight control circuitry is arranged to switch the backlight on or off in relation to whether the driving circuitry is driving the pixels or certain pixels with the pre-determined drive voltage level or with the overdrive drive voltage level.

12. The device as claimed in claim 11, wherein the backlight comprises a segmented backlight, and wherein the backlight is driven in a scanning mode of operation.

13. The device as claimed in claim 1, comprising a liquid crystal display.

14. A method of driving an active matrix liquid crystal display device comprising a plurality of pixels, comprising:

during a first phase driving each pixel with a pre-determined drive voltage level, and storing video data of a first fraction of one full frame in a partial frame store at a first rate;

during a second phase continuing to store video data of a second fraction of one full frame in the partial frame store at a first rate, reading data out of the partial frame store at a second rate which is greater than the first rate, processing the data read out of the partial frame store to derive an overdrive drive voltage level, and driving each pixel with the overdrive drive voltage level, wherein during the second phase the video data of the first fraction of one full frame stored in the partial frame is overwritten by the video data of the second fraction of one full frame as soon as the entire partial frame store is written.

15. The method as claimed in claim 14, wherein the first rate comprises the data rate of the input video data.

16. The method as claimed in claim 14, wherein input video data is read into the partial frame store substantially continuously across the first and second phases.

17. The method as claimed in claim 14, wherein the first and second phases are substantially continuous and each comprise approximately half the video frame period.

18. The method as claimed in claim 17, wherein the partial frame store has a capacity which is a fraction of the video data for a full frame, and wherein the fraction is substantially equal to ½.

19. The method as claimed in claim 14, wherein the first and second phases comprise sub-phases, and wherein the video frame period comprises a plurality of pairs of the sub-phases, each pair of sub-phases being used for driving a sub-set of the rows of pixels, and wherein during a pair of associated sub-phases, a respective portion of video data is read into the partial frame store and then read out.

20. The method as claimed in claim 19, wherein the partial frame store has a capacity which is a fraction of the video data for a full frame, and wherein the fraction is substantially equal to 1/(2N) where N is the number of sub-phases.

21. The method as claimed in claim 14, further comprising controlling a segmented backlight in a scanning mode of operation, synchronised with the timing of driving of the rows of pixels.

* * * * *